US007594833B2

(12) United States Patent
Oishi et al.

(10) Patent No.: US 7,594,833 B2
(45) Date of Patent: Sep. 29, 2009

(54) BOAT PROPULSION APPARATUS

(75) Inventors: Morihiro Oishi, Shizuoka (JP); Takashi Mizokawa, Shizuoka (JP); Hisashi Kazuta, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 84 days.

(21) Appl. No.: 12/034,766

(22) Filed: Feb. 21, 2008

(65) Prior Publication Data

US 2008/0207065 A1 Aug. 28, 2008

(30) Foreign Application Priority Data

Feb. 22, 2007 (JP) ..... 2007-041833

(51) Int. Cl.
*B63H 21/21* (2006.01)

(52) U.S. Cl. ..... 440/55; 440/1; 440/6

(58) Field of Classification Search ..... 440/1, 440/2, 6, 55, 84–87; 248/640–643; 701/21
See application file for complete search history.

(56) References Cited

U.S. PATENT DOCUMENTS 3,202,126 A * 8/1965 Urbassik ..... 440/55
3,580,212 A 5/1971 Fortson
3,785,329 A 1/1974 Shimanckas
3,839,986 A 10/1974 Meyer et al.
4,723,500 A 2/1988 Havins, Sr.
5,340,342 A 8/1994 Boda et al.
6,832,939 B2 12/2004 Rose et al.

FOREIGN PATENT DOCUMENTS

GB 1 561 630 2/1980

OTHER PUBLICATIONS

Official communication issued in counterpart European Application No. 08003197.4, mailed on May 15, 2008.

* cited by examiner

*Primary Examiner*—Ed Swinehart
(74) *Attorney, Agent, or Firm*—Keating & Bennett, LLP

(57) ABSTRACT

A boat propulsion apparatus is constructed such that an operation mode can be switched to a reverse mode and an amount of an output can be set by an easy operation without a complicated structure and further in which a main body of the propulsion apparatus can be locked to a hull. The boat propulsion apparatus is provided with a main body and a locking mechanism. The main body of the propulsion apparatus is provided with an electric motor, a throttle grip, a potentiometer arranged to detect an indication by the throttle grip, a first controller arranged to control an operation mode and an output of the electric motor depending on an output of the potentiometer, and second controller arranged to control the locking mechanism depending on an indication provided by the throttle grip. According to an operation for turning the throttle grip to a reverse mode area, the controller switches the electric motor to the reverse mode, and the second controller operates the locking mechanism to lock the main body of the propulsion apparatus to a hull.

10 Claims, 10 Drawing Sheets

(Counterclockwise)
Neutral point
(Clockwise)

Throttle grip turn angle
-80°
-15°
0°
15°
80°
Forward
Stop
Reverse

Potentiometer output

Stop mode sensor

Motor electric current

Reverse lock operation

BOAT PROPULSION APPARATUS

BACKGROUND OF THE INVENTION

1. Field of the Invention

The present invention relates to a boat propulsion apparatus and more particularly, to a boat propulsion apparatus of a motor-driven type.

2. Description of the Related Art

Conventional apparatuses of this kind are disclosed in U.S. Pat. No. 5,340,342 and U.S. Pat. No. 6,832,939.

In U.S. Pat. No. 5,340,342, an apparatus which can switch forward and reverse modes solely by a turning operation of a lever is disclosed.

On the other hand, in U.S. Pat. No. 6,832,939, an apparatus performing a so-called reverse lock is disclosed. In this conventional apparatus, forward and reverse modes can be switched by a selector switch, an electromagnetic solenoid is interlocked with a setting of the reverse mode by the switch, and a bounce up of a main body of a propulsion apparatus in a direction of a tilt up is prevented.

According to U.S. Pat. No. 5,340,342, the reverse lock is not interlocked with an operation of the lever. Therefore, another means needs to be provided in order to perform the reverse lock. Consequently, an operation and a structure become complicated.

On the other hand, according to U.S. Pat. No. 6,832,939, the reverse lock can be interlocked with a setting of the reverse mode by the switch. Another means, however, needs to be provided in order to set an amount of an output in each operation mode. Consequently, an operation and a structure become complicated.

SUMMARY OF THE INVENTION

In order to solve the problems described above, preferred embodiments of the present invention provide a boat propulsion apparatus in which an operation mode can be switched to a reverse mode and an amount of an output can be set by an easy operation without a complicated a structure and further in which a main body of a propulsion apparatus can be locked to a hull.

A boat propulsion apparatus according to a first preferred embodiment of the present invention includes: a main body mounted on a boat; and a locking mechanism arranged to prevent a swing of the main body of the propulsion apparatus in a direction of a tilt up; the main body of the propulsion apparatus has an electric motor, an indicating mechanism which is rotatable and which can indicate, by a position thereof, a type and an amount of an output of an operation mode having at least a forward mode and a reverse mode, a detecting mechanism arranged to detect an indication by the indicating mechanism, a first controller arranged to control an operation mode and an output of the electric motor depending on an output of the detecting mechanism, and a second controller arranged to control the locking mechanism depending on an indication provided by the indicating mechanism, a range of a turn of the indicating mechanism includes at least a forward mode area indicating the forward mode and a reverse mode area indicating a reverse mode, and the first controller switches the operation mode of the electric motor to the reverse mode and the second controller locks the main body of the propulsion apparatus to the hull by operating the locking mechanism depending on an operation for turning the indicating mechanism to the reverse mode area while the main body of the propulsion apparatus is mounted on the hull.

The operation mode preferably further includes a stop mode, a stop mode area indicating the stop mode has a predefined range including a neutral position located between the forward mode area and the reverse mode area in the range of a turning motion of the indicating mechanism, and the second controller locks the main body of the propulsion apparatus to the hull by operating the locking mechanism when the indicating mechanism is turned in a direction of the reverse mode area beyond a predefined position of the stop mode area.

The first controller preferably switches the electric motor to the reverse mode, and then the second controller locks the main body of the propulsion apparatus to the hull by operating the lock mechanism when the indicating mechanism is turned from the forward mode area to the reverse mode area.

The detecting mechanism preferably includes a potentiometer arranged to detect a position indicated by the indicating mechanism, and the first controller controls the electric motor depending on an output of the potentiometer.

The main body of the propulsion apparatus preferably further includes a housing for storing the potentiometer.

A stop mode sensor is preferably arranged to detect whether or not the indicating mechanism is indicating the stop mode, and the first controller preferably controls the electric motor further with reference to an output of the stop mode sensor.

The locking mechanism preferably includes an engaging section provided to the main body of the propulsion system and a catch section with which the engaging section can be engaged in order to lock the main body of the propulsion apparatus to the hull.

The second controller preferably includes a push section which can operate the engaging section in order to engage or release the engaging section in relation to the catch section and a control mechanism which mechanically controls an operation of the push section depending on an amount of a turn of the indicating mechanism.

The second controller preferably includes a push section preferably including an electromagnetic actuator which can operate the engaging section in order to engage or release the engaging section in relation to the catch section, a potentiometer arranged to detect a position indicated by the indicating mechanism, and a control section which controls the push section depending on an output of the potentiometer.

The engaging section preferably includes a lever provided on a side opposite to the hull in a vicinity of the main body of the propulsion apparatus and an arm which extends from the lever to a side of the hull and which can be engaged with the catch section tiltably provided to the main body of the propulsion apparatus, and the push section is disposed operably in relation to the lever.

An operation mode is preferably switched to the reverse mode and an amount of an output thereof is set solely by one operation for turning the indicating mechanism from the forward mode area to the reverse mode area, and, in addition to this, the main body of the propulsion apparatus is locked to the hull by the locking mechanism. Accordingly, another mechanism or another process is not necessary for setting the reverse lock or an output of an operation mode, and the reverse mode and an amount of an output thereof can be set with a simple structure and by a simple operation. In addition, a swinging movement of the main body of the propulsion apparatus in a direction of a tilt up can be prevented by the reverse lock.

The main body of the propulsion apparatus preferably is locked to the hull by the locking mechanism when the indicating mechanism is turned from the forward mode area to the predefined position of the stop mode area. Consequently, if the predefined position of the stop mode area, which is a position for enabling the reverse lock, is closer to the reverse mode area than to the neutral position, an operation mode can be switched to the reverse mode immediately after the reverse lock is enabled in a case in which the operation mode is switched from the forward mode to the stop mode and further to the reverse mode. On the other hand, a smooth operation is performed without unnecessarily enabling the reverse lock in a case in which the operation mode is switched from the forward mode to the stop mode and further to the forward mode.

When the indicating mechanism is turned from the forward mode area to the reverse mode area, the electric motor is switched to the reverse mode first, and the main body of the propulsion apparatus is locked to the hull by the locking mechanism afterwards. As a result, the reverse lock can be surely enabled only when the reverse mode is enabled. Therefore, the reverse lock is not mistakenly enabled. It is preferable that the reverse lock is enabled after the electric motor is switched to the reverse mode and before propulsive force is generated.

A position indicated by the indicating mechanism and a state of an operation for turning the indicating mechanism can be easily detected by the potentiometer. Therefore, the electric motor can be easily controlled by the first controller.

The potentiometer can be protected and deterioration and breakage of the potentiometer can be prevented by housing the potentiometer in the housing. Therefore, performance of the potentiometer can be maintained.

A detecting error of the potentiometer can be corrected by controlling the electric motor further with reference to an output of the stop mode sensor having high detecting accuracy. Therefore, the electric motor can be accurately controlled. In addition, an open circuit in the potentiometer can be detected.

If the catch section is provided to a structure on a side of the hull such as the hull and a member fixed on the hull (a bracket, for example), for example, the reverse lock can be easily enabled solely by engaging the engaging section provided to the main body of the propulsion apparatus with the catch section.

An operation of the push section can be mechanically controlled by the control mechanism. Therefore, electrical elements are not necessary for controlling the push section and the reverse lock.

An operation of the push section including the electromagnetic actuator can be controlled depending on an output of the potentiometer. Therefore, the push section and the reverse lock are easily controlled.

The push section preferably operates the lever provided on a side opposite to the hull in a vicinity of the main body of the propulsion apparatus. Therefore, the arm can be easily tilted and engaged with the catch section by the principle of lever. Thus, the reverse lock is smoothly enabled and disabled. In addition, a large free space is provided on the side opposite to the hull in the vicinity of the main body of the propulsion apparatus. Therefore, the lever can be long, and the lever can be operated by the push section even in a state in which a rudder is turned.

According to preferred embodiments of the present invention, another mechanism or another process is not necessary for setting the reverse lock or an output of an operation mode, and the reverse mode and an amount of an output thereof can be set with a simple structure and by a simple operation. In addition, a swing of the main body of the propulsion apparatus in a direction of a tilt up can be prevented by the reverse lock.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments according to the present invention will be described hereinafter with reference to accompanying drawings.

Figure 1:
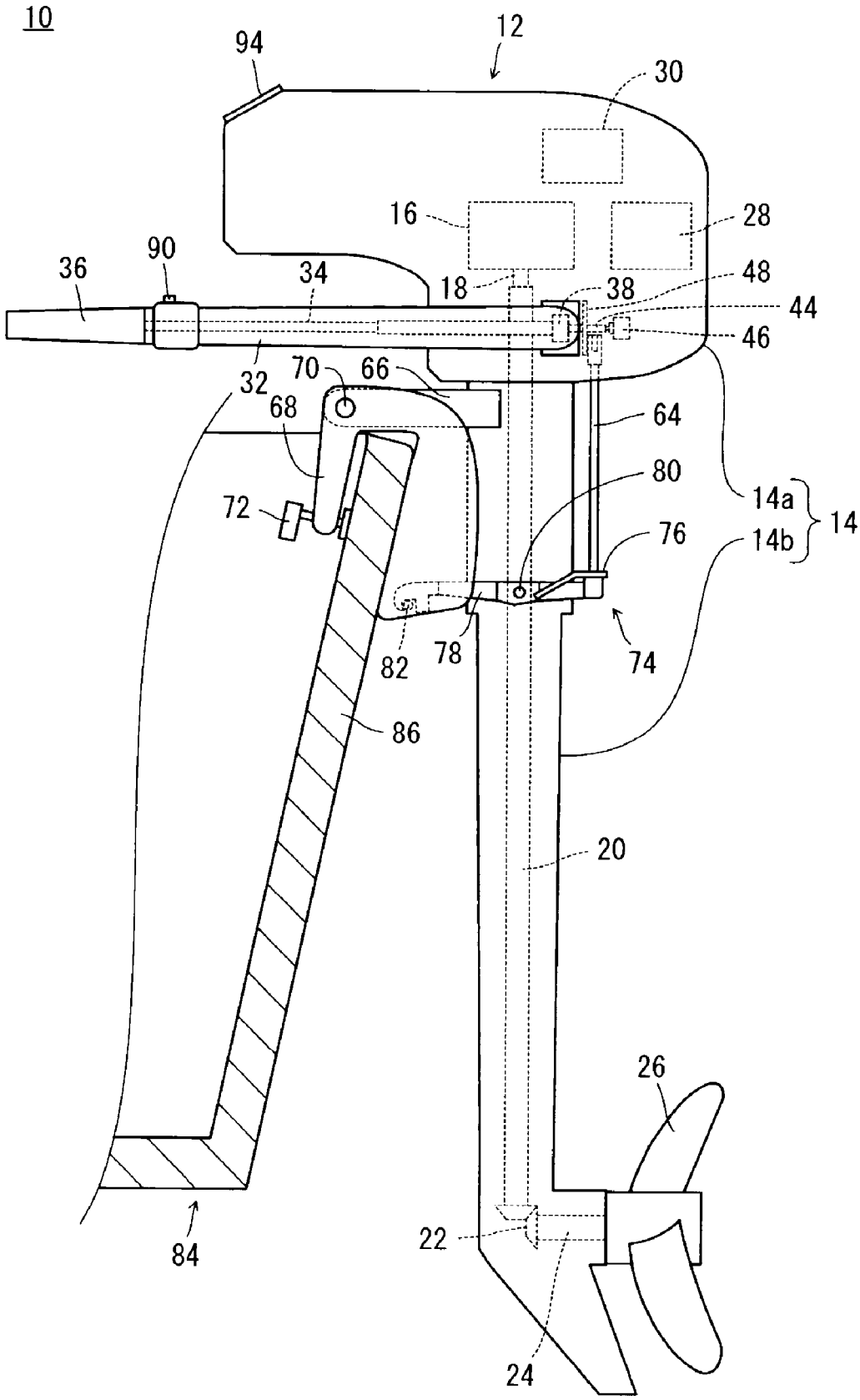
FIG. 1 shows a view illustrating a boat propulsion apparatus according to a preferred embodiment of the present invention.

FIG. 1 shows a boat propulsion apparatus 10 of a motor-driven type according to a preferred embodiment of the present invention. The boat propulsion apparatus 10 may be constituted as an outboard motor or as a part of a boat.

The boat propulsion apparatus 10 includes a main body 12 of the propulsion apparatus. The main body 12 of the propulsion apparatus includes a housing 14 having an upper housing 14*a* and a lower housing 14*b*. An electric motor 16 is provided in the upper housing 14*a*, and a drive shaft 20 is connected to a rotor 18 of the electric motor 16. The drive shaft 20 is provided in a range from the upper housing 14*a* to the lower housing 14*b*, and the drive shaft 20 is connected to a propeller shaft 24 via a bevel gear 22. A propeller 26 is connected to an end of the propeller shaft 24. A rotational direction of the propeller 26 is determined by a rotational direction of the electric motor 16.

In addition, a controller 28 and a battery 30 are provided in the upper housing 14*a*, and one end of a steering rod 32 is attached to a side section of the upper housing 14*a*. The steering rod 32 extends generally in the horizontal direction, and a direction of the main body 12 of the propulsion apparatus is changed by swinging the steering rod 32 in the width direction. Thus, steering operation of a hull 84 (described below) can be performed.

Figure 2:
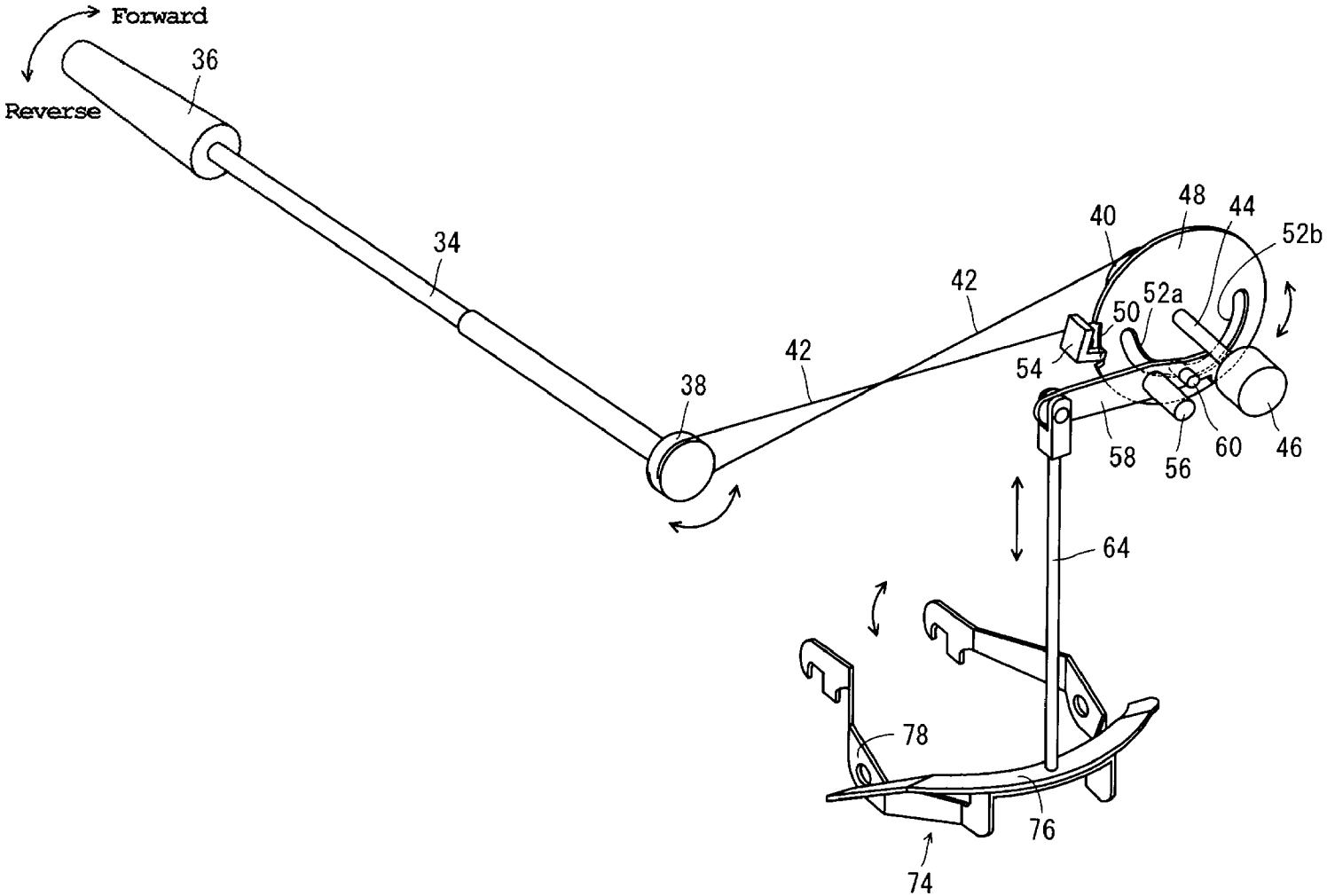
FIG. 2 shows a perspective view illustrating a major link structure of the preferred embodiment in FIG. 1.
Figure 3:
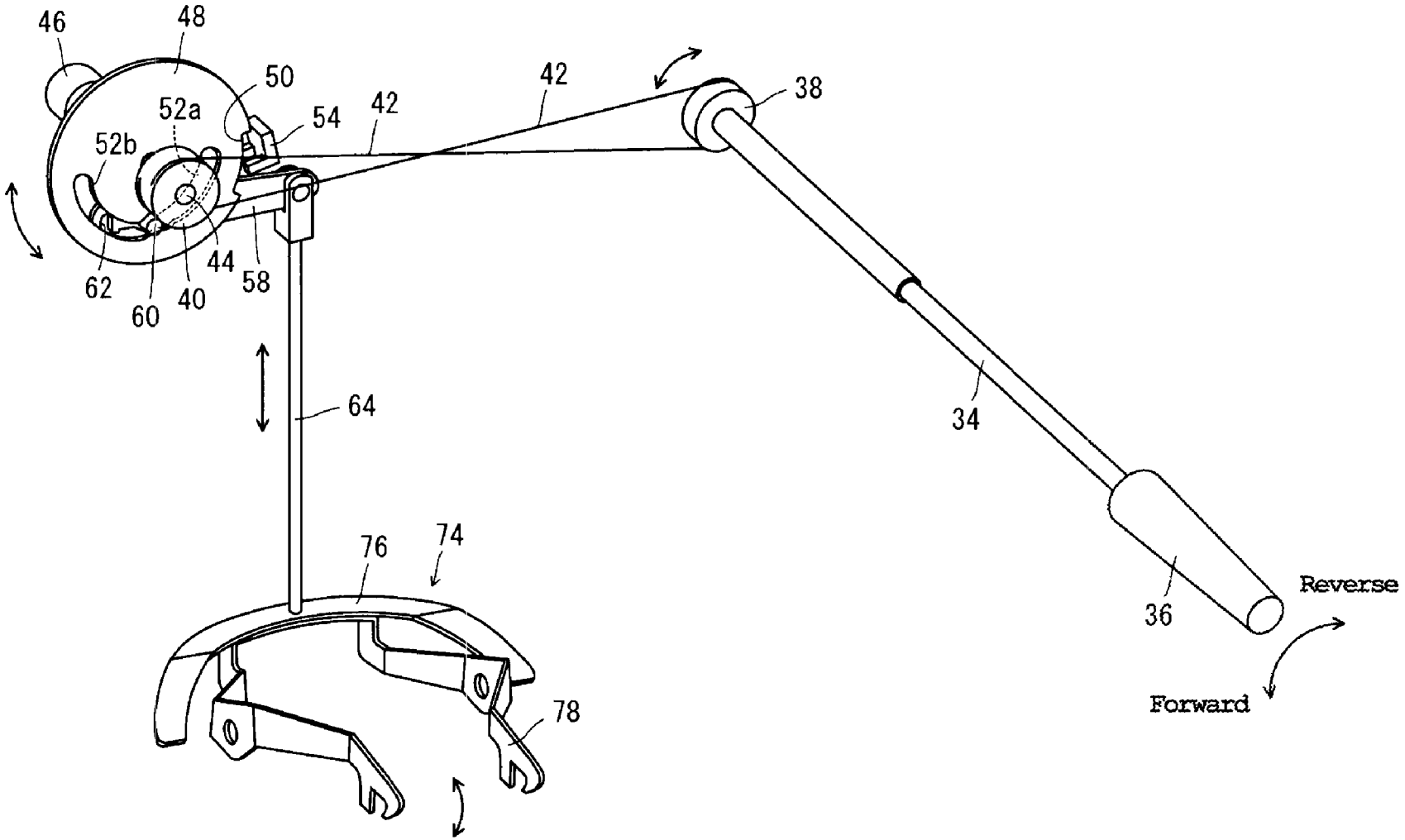
FIG. 3 shows a perspective view illustrating a major link structure of the preferred embodiment in FIG. 1.
Figure 4:
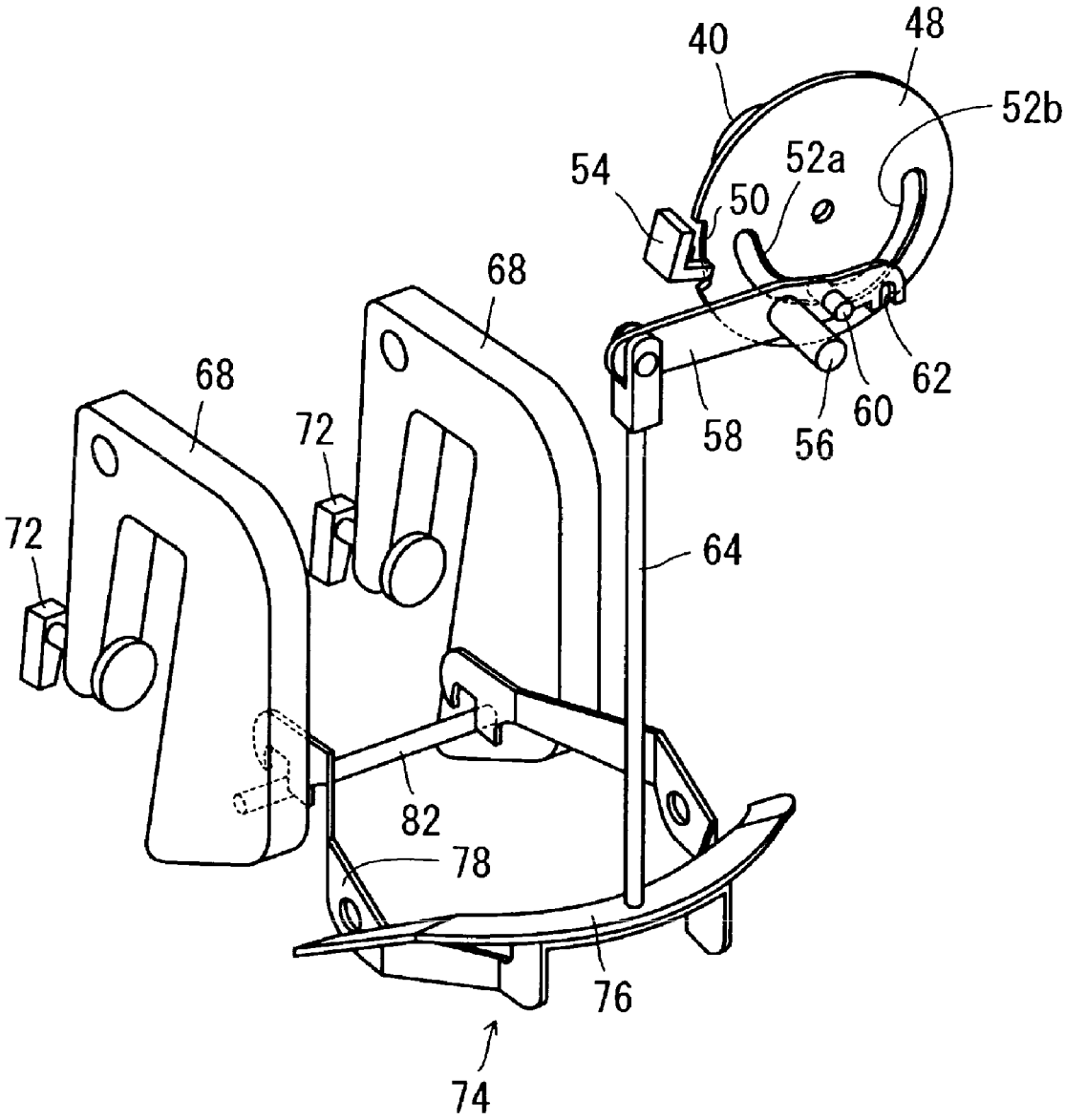
FIG. 4 shows a perspective view illustrating a vicinity of locking mechanism of the preferred embodiment in FIG. 1.

As shown further in FIG. 2 to FIG. 4, a link shaft 34 extending in an axial direction is provided in the steering rod 32, and a throttle grip 36 connected to the link shaft 34 is provided on a second end of the steering rod 32. An operation mode of the electric motor 16 and an amount of an output thereof can be adjusted by turning the throttle grip 36 in a circumferential direction.

A pulley 38 is attached to a first end of the link shaft 34, and the pulley 38 and a pulley 40 in the upper housing 14*a* are connected by two cables 42. The pulley 40 is turned when the pulley 38 turns.

A rotational shaft 44 is attached to the pulley 40, and a potentiometer 46 is provided at an end of the rotational shaft 44. An amount of rotation of the pulleys 40 and 38 and the throttle grip 36 and a position indicated by the throttle grip 36 can be detected by the potentiometer 46. An output of the potentiometer 46 is given to the controller 28.

In addition, a cam plate 48 preferably in the shape of a disk is attached to the rotational shaft 44 at a position between the pulley 40 and the potentiometer 46. The cam plate 48 is turned when the pulley 40 turns.

Figure 5A:
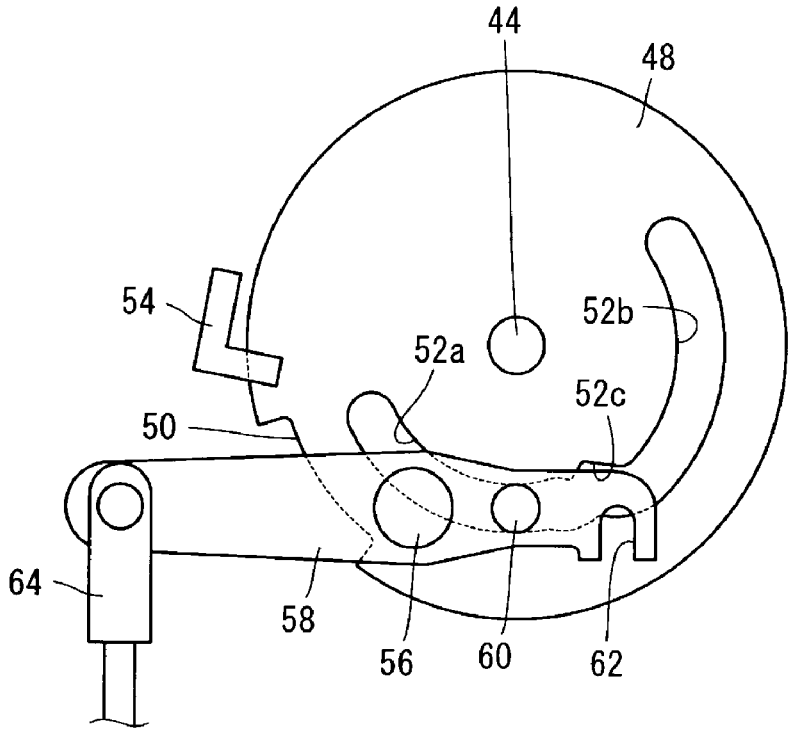
FIG. 5A shows a view illustrating a control mechanism at a time when a reverse lock is disabled.
Figure 5B:
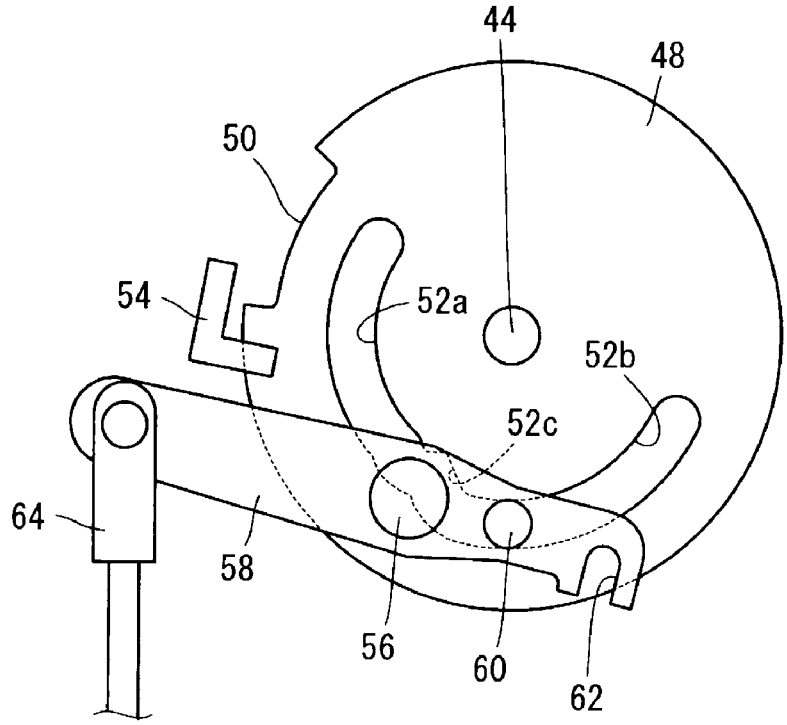
FIG. 5B shows a view illustrating the control mechanism at a time when the reverse lock is enabled.

As shown further in FIGS. 5A and 5B, a cutout 50 used for detecting the stop mode is formed at the outer circumference of the cam plate 48. In addition, grooves 52*a* and 52*b* in a shape of an arc passing through the cam plate 48 are continuously formed in the cam plate 48 via a groove 52*c*. The grooves 52*a* and 52*c* are closer to the center of the cam plate 48 than the groove 50*b* is.

Further, a stop mode sensor 54 is disposed in a vicinity of the outer circumference of the cam plate 48 in order to detect the cutout 50. In addition, an arm 58 generally in a shape of a strip of paper supported by a support shaft 56 is disposed in a vicinity of a major surface on a side of the potentiometer 46 of the cam plate 48.

A collar 60 is attached to a side closer to an end of the arm 58, and the collar 60 is inserted into the grooves 52*a* to 52*c* of the cam plate 48.

In addition, a spring member (not shown) is attached to an end section 62 of the arm 58, and the arm 58 is constantly biased in an upper direction by the spring member. As a result, a relative slide of the collar 60 in relation to the grooves 52*a* to 52*c* becomes smooth, and traceability becomes accurate. Further, a feeling of a click at a time when the collar 60 enters the groove 52*c* of the cam plate 48 is improved. Therefore, it is easy for a user to know the neutral position, and a feeling of operation is improved.

Moreover, a push section 64 in a shape of a rod is attached to a base end of the arm 58.

As shown in FIG. 1, a mount (swivel bracket) 66 supporting the lower housing 14*b* is formed in an upper section of a side surface of the lower housing 14*b*. The mount 66 is connected tiltably in the vertical direction to a pair of brackets (clamp brackets) 68 disposed on both sides thereof via a tilt shaft 70. The brackets 68 have a clamp 72. In addition, a stopper (not shown) with which the mount 66 is in contact in a state in which the main body 12 of the propulsion apparatus is tilted down to a lower limit position (the state shown in FIG. 1) is provided to the brackets 68.

In addition, an engaging section 74 generally in a shape of a letter Π operated by the push section 64 is tiltably supported on an outer circumference in a position closer to a top of the lower housing 14*b*. As shown further in FIG. 2 to FIG. 4, the engaging section 74 curves along an outer circumference of the lower housing 14*b* and includes a lever 76 in a shape of a board provided on a side opposite to the hull 84 (described below) and an arm 78 extending from the lever 76. The arm 78 is connected tiltably in the vertical direction to the lower housing 14*b* by a support shaft 80, and a side of an end section of the arm 78 is constantly biased in a lower direction by a spring member not shown in the drawing. On the other hand, a catch rod 82 with which an end section of the arm 78 is engaged is attached to the brackets 68.

Further, the boat propulsion apparatus 10 is mounted on the hull 84 by attaching the brackets 68 to a transom 86 of the hull 84 and by fastening the clamp 72.

In the constitution described above, when the cam plate 48 turns synchronously with a turn of the throttle grip 36, the collar 60 relatively slides from the grooves 52*a* to 52*c*. Because the height of the groove 52*a* and the height of the groove 52*b* are different, the collar 60 moves up and down. As the collar 60 moves up and down, the arm 58 swings on the support shaft 56, and consequently the push section 64 moves up and down and operates the lever 76. For example, as shown in FIG. 5A, when the collar 60 is at the position of the groove 52*a*, the push section 64 is lowered. Accordingly, the arm 78 is released from the catch rod 82. Therefore, the reverse lock is disabled. On the other hand, as shown in FIG. 5B, when the collar 60 is at the position of the groove 52*b*, the push section 64 is raised. Accordingly, the arm 78 is engaged with the catch rod 82. Therefore, the reverse lock is enabled. The position of insertion of the collar 60 passes the groove 52*c* when the position of insertion of the collar 60 is moving from the grooves 52*a* to 52*b* or in the opposite direction. The fact that the reverse lock is enabled or disabled is known by a user because the position of insertion of the collar 60 passes the groove 52*c*. Therefore, operability is further enhanced.

An electric constitution of the boat propulsion apparatus 10 will be described hereinafter with reference to FIG. 6.

An output from the potentiometer 46 and the stop mode sensor 54 is given to the controller 28. In addition, the battery 30 is connected to the controller 28 via a relay 88, and a switching operation of the relay 88 is controlled by a main switch 90. As shown in FIG. 1, the main switch 90 is provided on a steering rod 34.

In addition, the controller 28 controls a motor driver 92 and thereby the electric motor 16 depending on an output of the potentiometer 46. Moreover, a display section 94 on which information on steering or the like is displayed is controlled by the controller 28. As shown in FIG. 1, the display section 94 is provided on the upper housing 14*a*.

Moreover, FIGS. 7A to 7E show outputs of the potentiometer 46, outputs of the stop mode sensor 54, electric currents of the motor, and operations of the reverse lock in relation to a turn of the throttle grip 36.

Figures 7A, 7B, 7C, 7D, 7E:
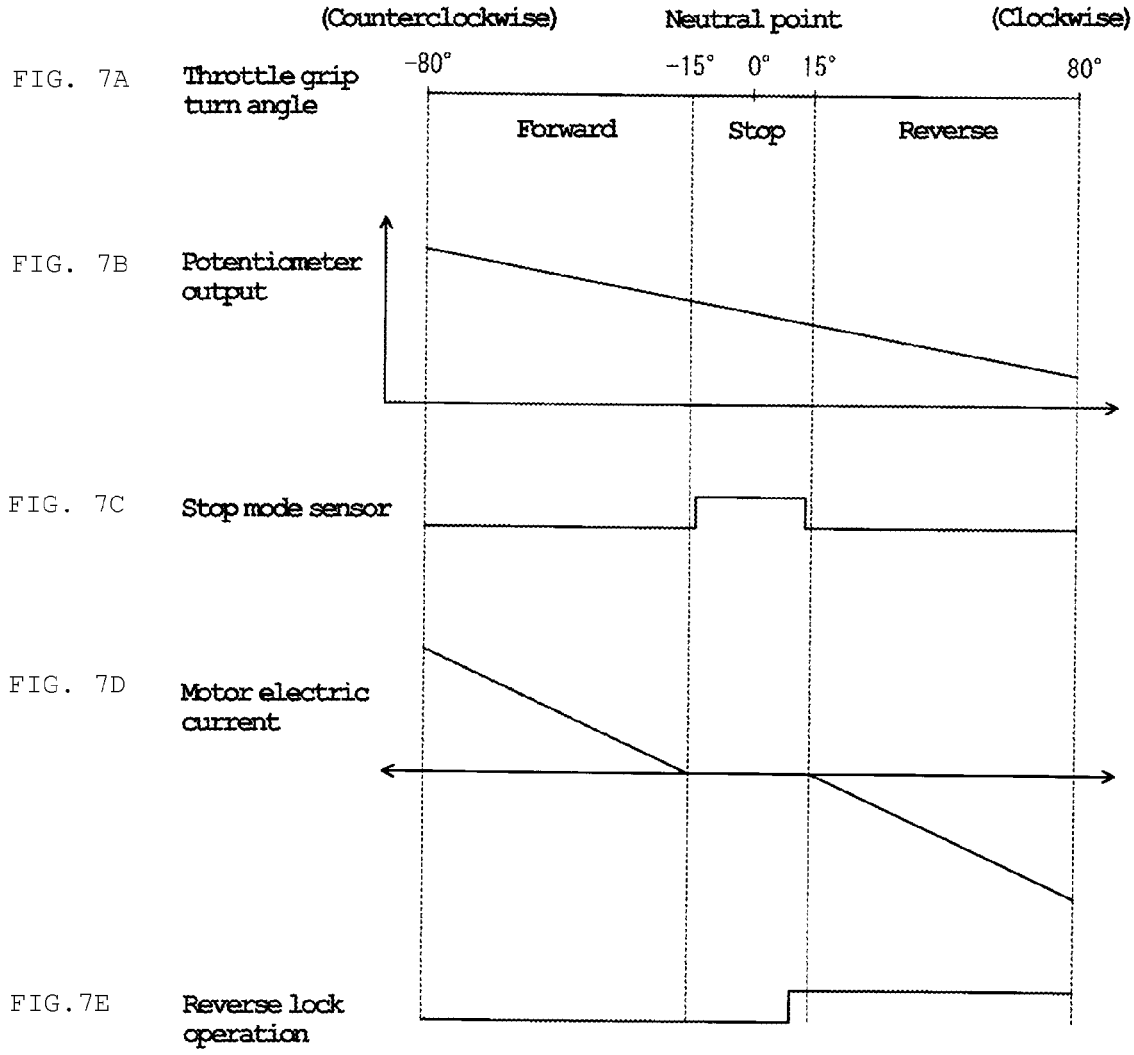
FIGS. 7A-7E show a graph illustrating outputs of each section or the like in relation to a turn of a throttle grip.

As shown in FIG. 7A, if the throttle grip 36 is turned counterclockwise from the state of the stop mode (the state of neutral), the forward mode is set. On the other hand, if the throttle grip 36 is turned clockwise from the state of the stop mode, the reverse mode is set. In this preferred embodiment, the throttle grip 36 can be turned in a range between about ±80 degrees at the maximum, where the stop mode area indicating the stop mode is in a range between about ±15 degrees including the neutral position, the forward mode area indicating the forward mode is in a range between about −15 degrees and about −80 degrees, and the reverse mode area indicating the reverse mode is in a range between about 15 degrees and about 80 degrees.

As shown in FIG. 7B, outputs of the potentiometer 46 vary linearly according to a position indicated by the throttle grip 36. Accordingly, the position indicated by the throttle grip 36 can be detected depending on an output of the potentiometer 46.

An output of the stop mode sensor 54 is at a high level when the throttle grip 36 indicates the stop mode. As understood from FIG. 7C, a period in which the stop mode sensor 54 is at the high level is slightly shorter than the stop mode area of the throttle grip 36. As a result, when an output of the stop mode sensor 54 is at the high level, the fact that the throttle grip 36 is indicating the stop mode is detected with high accuracy. The period of the high level of the stop mode sensor 54 and a timing thereof are determined by a position of the stop mode sensor 54, a length of the cutout 50, and the like. The controller 28 controls the electric motor 16 not only depending on an output of the potentiometer 46 but also with reference to an output of the stop mode sensor 54. Accordingly, even if there is an error in detection by the potentiometer 46, the controller 28 can recognize an indication of the stop mode by the throttle grip 36 with high accuracy by referring to an output of the stop mode sensor 54.

As shown in FIG. 7B, electric currents for the motor flowing in the electric motor 16 are controlled depending on a position of the throttle grip 36. In other words, an operation mode of the electric motor 16 is controlled by the controller 28 depending on the position of the throttle grip 36. When the throttle grip 36 is indicating the stop mode, the electric current for the motor is zero. Accordingly, the electric motor 16 stops.

Operations of the reverse lock are shown in FIG. 7E. When the throttle grip 36 is turned approximately 10 degrees clockwise from the neutral position, the reverse lock is enabled. Specifically, when the throttle grip 36 is turned approximately 10 degrees clockwise from the neutral position, the collar 60 is at a position of the groove 52*b* of the cam plate 48. Accordingly, the push section 64 is raised, and a side of an end of the arm 78 is engaged with the catch rod 82. Thus, the reverse lock is enabled.

In the present preferred embodiment, the locking mechanism preferably includes the engaging section 74, the support shaft 80, the catch rod 82 as the catch section, and the spring member (not shown). The indicating mechanism preferably includes the throttle grip 36. The detecting mechanism preferably includes the potentiometer 46. The first controller preferably includes the controller 28. The second controller preferably includes the push section 64 and a control mechanism including the cam plate 48, the support shaft 56, the arm 58, the collar 60, and the spring member (not shown). In addition, the transmission mechanism preferably includes the link shaft 34, the pulleys 38 and 40, the cables 42, and the rotational shaft 44.

According to the boat propulsion apparatus 10, an operation mode is switched to the reverse mode and an amount of an output thereof is set by the controller 28 solely by one operation for turning the throttle grip 36 from the forward mode area to the reverse mode area. Moreover, the push section 64 is raised, and the engaging section 74 is engaged with the catch rod 82. Therefore, the main body 12 of the propulsion apparatus is locked to the hull 84. Accordingly, another mechanism or another process is not necessary for setting the reverse lock or an output of an operation mode, and the reverse mode and an amount of an output thereof can be set with a simple structure and by a simple operation. In addition, a swinging motion of the main body 12 of the propulsion apparatus and the boat propulsion apparatus 10 in a direction of a tilt up can be prevented by the reverse lock.

In addition, when the throttle grip 36 is turned from the forward mode area to a predefined position of the stop mode area, the push section 64 is raised, and the engaging section 74 is engaged with the catch rod 82. Therefore, the main body of the propulsion apparatus is locked to the hull. Consequently, because the predefined position of the stop mode area, which is a position for enabling the reverse lock, is closer to the reverse mode area than to the neutral position (a position approximately 10 degrees from the neutral position in a direction of a clockwise turn), an operation mode can be switched to the reverse mode immediately after the reverse lock is enabled in a case in which the operation mode is switched from the forward mode to the stop mode and further to the reverse mode. On the other hand, a smooth operation is performed without unnecessarily enabling the reverse lock in case that the operation mode is switched from the forward mode to the stop mode and further to the forward mode.

Moreover, a position indicated by the throttle grip 36 and a state of an operation of turning the throttle grip 36 can be easily detected by the potentiometer 46. Therefore, the electric motor 16 can be easily controlled by the controller 28.

The potentiometer 46 can be protected, and deterioration and breakage of the potentiometer 46 can be prevented by housing the potentiometer 46 in the housing 14. Therefore, performance of the potentiometer 46 can be maintained.

In addition, a detecting error of the potentiometer 46 can be corrected by controlling the electric motor 16 further with reference to an output of the stop mode sensor 54 having high detection accuracy. Therefore, the electric motor 16 can be accurately controlled. In addition, an open circuit in the potentiometer 46 can be detected by using the stop mode sensor 54.

Moreover, the reverse lock can be easily enabled solely by mounting the catch rod 82 on the brackets 68 fixed on the hull 84 and by engaging the engaging section 74 provided to the main body 12 of the propulsion apparatus with the catch rod 82. The catch section may be provided directly to the hull 84.

In addition, an operation of the push section 64 can be mechanically controlled by the control mechanism. Therefore, electrical elements are not necessary for controlling the push section 64 and the reverse lock.

Moreover, the push section 64 operates in relation to the lever 76 provided on a side opposite to the hull 84 in a vicinity of the main body 12 of the propulsion apparatus. Therefore, the arm 78 can be easily tilted and engaged with the catch rod 82 by the principle of lever. Thus, the reverse lock is smoothly enabled and disabled. In addition, a large free space is provided on the side opposite to the hull 84 in the vicinity of the main body 12 of the propulsion apparatus. Therefore, the lever 76 can be long, and the lever 76 can be operated by the push section 64 in a state in which a rudder is turned.

In the present preferred embodiment, the reverse mode is preferably set after the reverse lock is enabled in the stop mode. The present invention, however, is not limited to the preferred embodiment above.

The reverse lock may be enabled after the throttle grip 36 is turned to the reverse mode area and also the electric motor 16 is switched to the reverse mode. This operation is easily achieved, for example, by elongating the groove 52*a* of the cam plate 48.

In this case, the reverse lock can be surely enabled only when the reverse mode is enabled. Therefore, the reverse lock is not mistakenly enabled.

Figure 6:
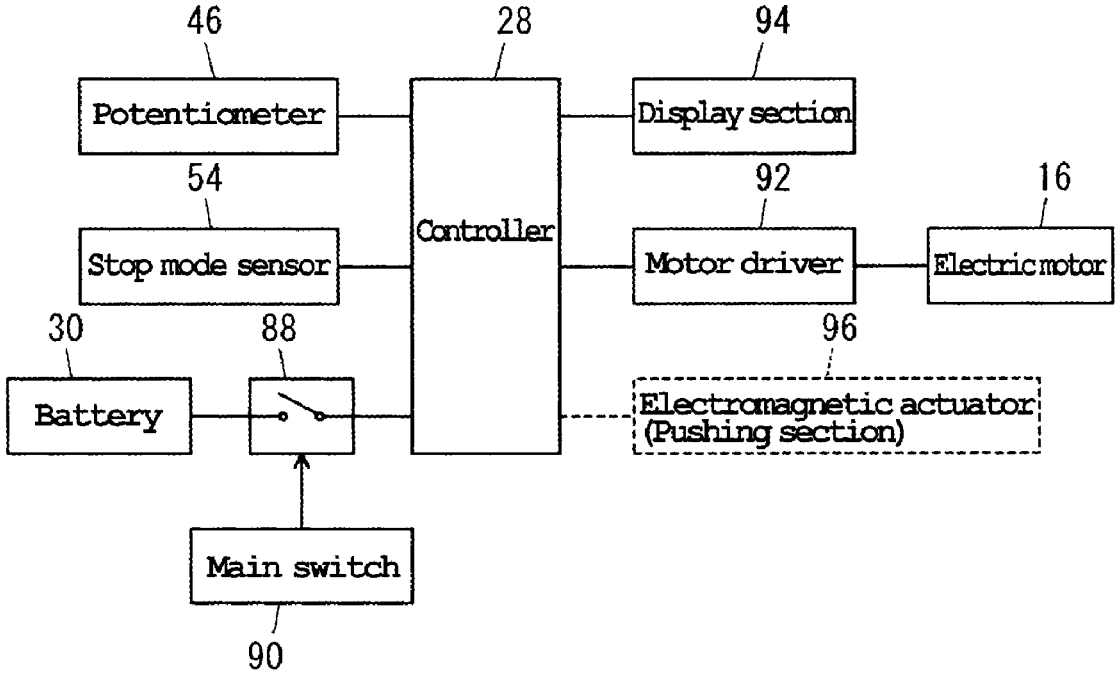
FIG. 6 is a block diagram illustrating an electric constitution according to a preferred embodiment of the present invention.
Figure 8:
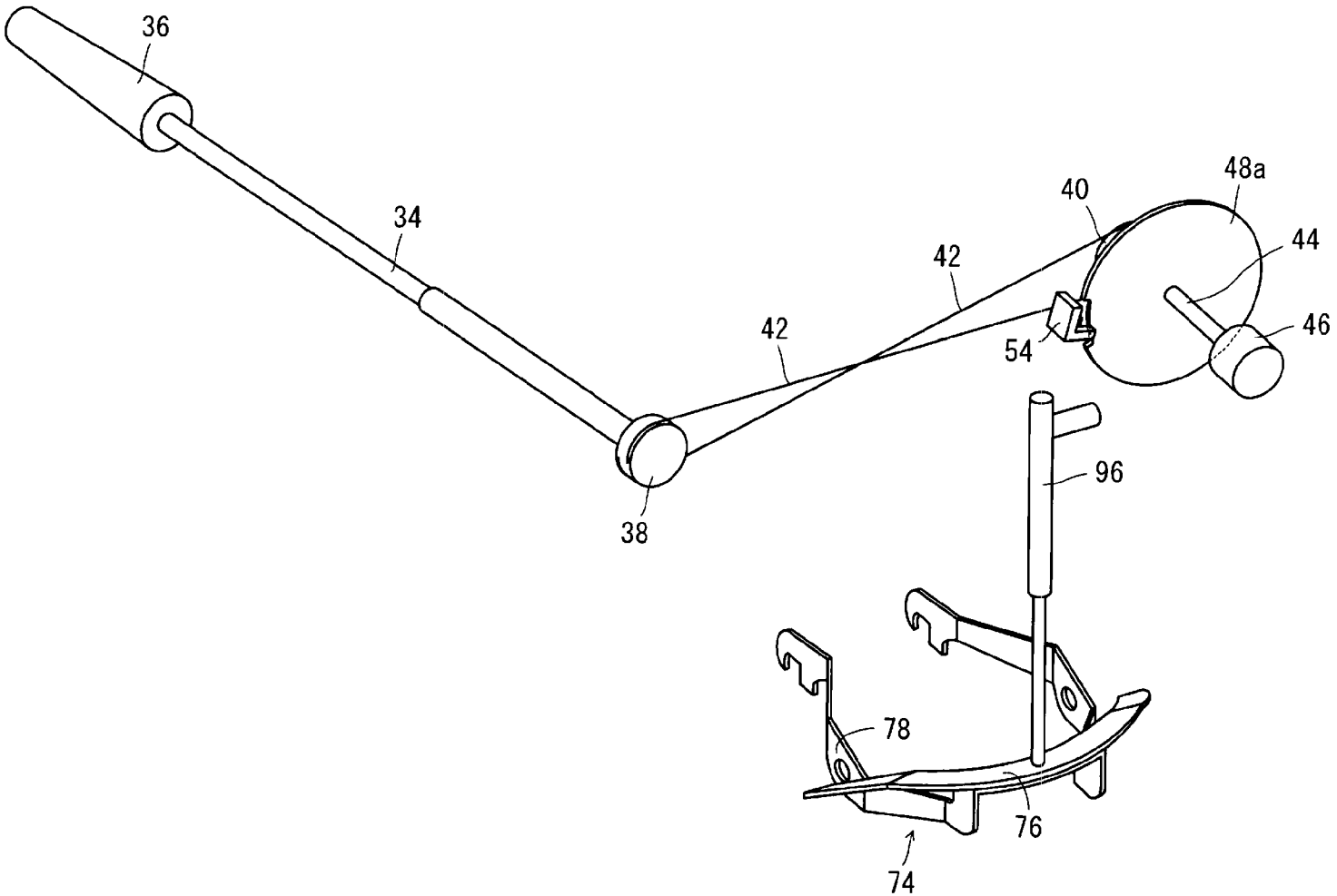
FIG. 8 shows a perspective view illustrating a major link structure of another preferred embodiment of the present invention.

In addition, as understood from FIG. 6 and FIG. 8, the second controller may be constituted by including a push section 96 formed with an electromagnetic actuator, the potentiometer 46, and the controller 28 as a control section which controls the push section 96 depending on an output of the potentiometer 46.

In this case, an operation of the push section 96 including the electromagnetic actuator can be controlled by the controller 28 already described above depending on an output of the potentiometer 46 already described above. Therefore, the push section 96 and the reverse lock are controlled and constituted easily.

In this case, a cam plate 48*a* is used by the stop mode sensor 54 in order to detect the stop mode.

Figure 9:
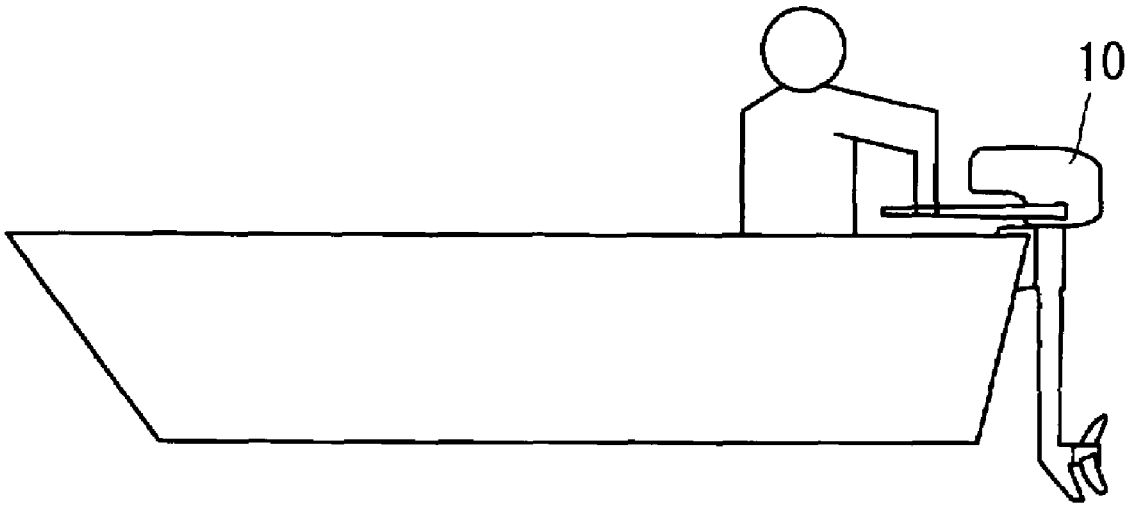
FIG. 9 shows a view illustrating a case in which a preferred embodiment of the present invention is applied to a fishing boat.

The boat propulsion apparatus 10 can be used for a fishing boat as shown in FIG. 9.

Figure 10:
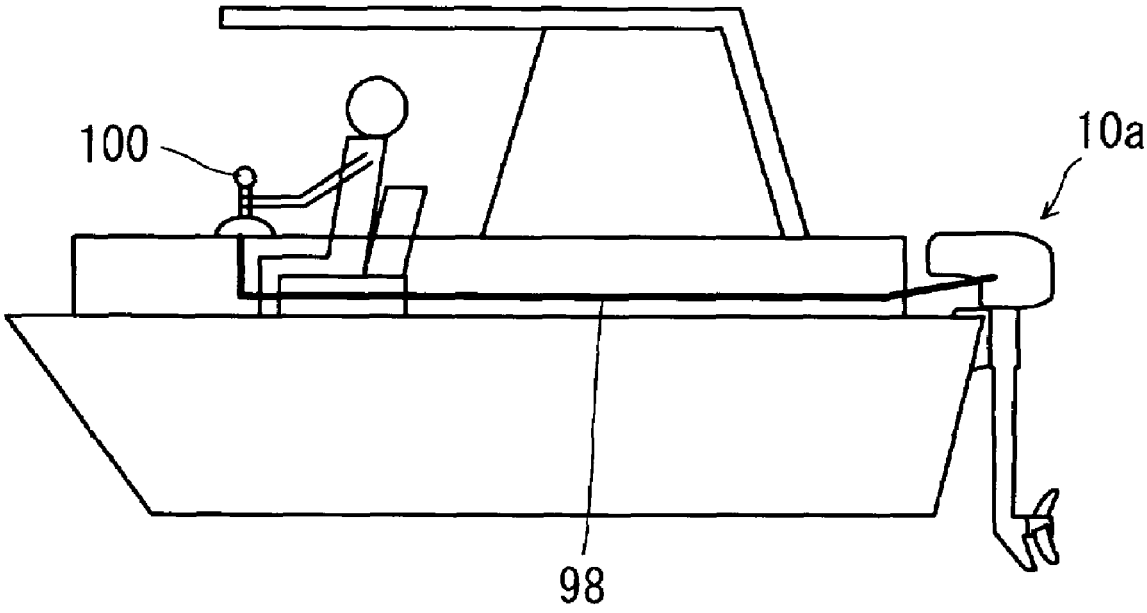
FIG. 10 shows a view illustrating a case in which a preferred embodiment of the present invention is applied to a pontoon boat.

In addition, various preferred embodiments of the present invention can be applied to a boat propulsion apparatus 10*a* which can be used for a pontoon boat as shown in FIG. 10, for example. The boat propulsion apparatus 10*a* is operated by remote control with a throttle lever 100 as the indicating mechanism via a wire cable 98. The boat propulsion apparatus 10*a* may be operated by wireless remote control without using the wire cable 98.

In addition, the indicating mechanism may be of a pedal type which can be the operation by foot.

Moreover, an optical position detection sensor and a magnetic sensor may be used in place of the potentiometer 46.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion apparatus, comprising:

a main body arranged to be mounted on a hull; and a locking mechanism arranged to prevent a swinging motion of the main body in a direction of a tilt up; wherein the main body includes:

an electric motor;

an indicating mechanism arranged to be rotatable and to indicate, by a position thereof, a type and an amount of an output of an operation mode having at least a forward mode and a reverse mode;

a detecting mechanism arranged to detect an indication provided by the indicating mechanism;

a first controller arranged to control an operation mode and an output of the electric motor depending on an output of the detecting mechanism; and a second controller arranged to control the locking mechanism depending on an indication provided by the indicating mechanism; wherein a range of rotation of the indicating mechanism includes at least a forward mode area indicating the forward mode and a reverse mode area indicating the reverse mode; and the first controller is arranged to switch the operation mode of the electric motor to the reverse mode and the second controller is arranged to lock the main body of the propulsion apparatus to the hull by operating the locking mechanism depending on an operation of rotating the indicating mechanism to the reverse mode area while the main body of the propulsion apparatus is mounted on the hull.

2. The boat propulsion apparatus according to claim 1, wherein the operation mode further includes a stop mode, a stop mode area indicating the stop mode has a predefined range including a neutral position located between the forward mode area and the reverse mode area in the range of rotation of the indicating mechanism, and the second controller is arranged to lock the main body of the propulsion apparatus to the hull by operating the locking mechanism when the indicating mechanism is turned in a direction of the reverse mode area beyond a predefined position of the stop mode area.

3. The boat propulsion apparatus according to claim 1, wherein the first controller is arranged to switch the electric motor to the reverse mode, and then the second controller is arranged to lock the main body of the propulsion apparatus to the hull by operating the locking mechanism when the indicating mechanism is rotated from the forward mode area to the reverse mode area.

4. The boat propulsion apparatus according to claim 1, wherein the detecting mechanism includes a potentiometer arranged to detect a position indicated by the indicating mechanism, and the first controller is arranged to control the electric motor depending on an output of the potentiometer.

5. The boat propulsion apparatus according to claim 4, wherein the main body of the propulsion apparatus further includes a housing arranged to store the potentiometer.

6. The boat propulsion apparatus according to claim 4, further comprising a stop mode sensor arranged to detect whether or not the indicating mechanism is indicating the stop mode, and the first controller is arranged to control the electric motor based on an output of the stop mode sensor.

7. The boat propulsion apparatus according to claim 1, wherein the locking mechanism includes an engaging section provided to the main body of the propulsion system and a catch section with which the engaging section can be engaged in order to lock the main body of the propulsion apparatus to the hull.

8. The boat propulsion apparatus according to claim 7, wherein the second controller includes a push section which can operate the engaging section in order to engage or release the engaging section in relation to the catch section and a control mechanism which mechanically controls an operation of the push section depending on an amount of rotation of the indicating mechanism.

9. The boat propulsion apparatus according to claim 7, wherein the second controller includes a push section including an electromagnetic actuator arranged to operate the engaging section in order to engage or release the engaging section in relation to the catch section, a potentiometer arranged to detect a position indicated by the indicating mechanism, and a control section which controls the push section depending on an output of the potentiometer.

10. The boat propulsion apparatus according to claim 8, wherein the engaging section includes a lever provided on a side opposite to the hull in a vicinity of the main body of the propulsion apparatus and an arm which extends from the lever to a side of the hull and which can be engaged with catch section tiltably provided to the main body of the propulsion apparatus, and the push section is disposed operably in relation to the lever.

* * * * *